US011067100B2

(12) United States Patent
Enevoldsen et al.

(10) Patent No.: US 11,067,100 B2
(45) Date of Patent: Jul. 20, 2021

(54) DEVICE FOR SUPPLYING PORTS TO A MACHINE SECTION OF A HYDRAULIC MACHINE ARRANGEMENT

(71) Applicant: Danfoss A/S, Nordborg (DK)

(72) Inventors: Georg Enevoldsen, Nordborg (DK); Poul Erik Hansen, Nordborg (DK); Frank Holm Iversen, Nordborg (DK)

(73) Assignee: DANFOSS A/S, Nordborg (DK)

( * ) Notice: Subject to any disclaimer, the term of this patent is extended or adjusted under 35 U.S.C. 154(b) by 0 days.

(21) Appl. No.: 16/879,285

(22) Filed: May 20, 2020

(65) Prior Publication Data

US 2020/0370570 A1 Nov. 26, 2020

(30) Foreign Application Priority Data

May 21, 2019 (DE) ..... 102019113536.2

(51) Int. Cl.
*F15B 3/00* (2006.01)
*F03C 1/34* (2006.01)
(Continued)

(52) U.S. Cl.
CPC ..... *F15B 3/00* (2013.01); *F03C 1/0655* (2013.01); *F04B 53/06* (2013.01); *F15B 20/005* (2013.01);
(Continued)

(58) Field of Classification Search
CPC ..... F03C 1/0655; F04B 1/2042; F04B 53/04; F04B 53/06; F04B 2201/0208; F04B 2201/0803; F15B 20/005
See application file for complete search history.

(56) References Cited

U.S. PATENT DOCUMENTS 3,485,047 A * 12/1969 Behrens ..... F03C 1/0636 60/450
3,661,055 A * 5/1972 Pruvot ..... F01B 3/0052 91/486
(Continued)

FOREIGN PATENT DOCUMENTS

| | | | |
|---|---|---|---|
| DE | 1 951 234 | A | 4/1971 |
| EP | 1 308 620 | A1 | 5/2003 |
| EP | 3109470 | A1 | 12/2016 |
| EP | 3 168 470 | A1 | 5/2017 |
| JP | S50-4602 | A | 1/1975 |
| WO | 01/65113 | A1 | 9/2001 |
| WO | 2015/055332 | A1 | 4/2015 |

OTHER PUBLICATIONS

Search Report for Great Britain Patent Application No. GB2005396.3 dated Sep. 14, 2020.

*Primary Examiner* — F Daniel Lopez
*Assistant Examiner* — Matthew Wiblin
(74) *Attorney, Agent, or Firm* — McCormick, Paulding & Huber PLLC

(57) ABSTRACT

The invention relates to a device for supplying ports to a machine section (26) of a hydraulic machine arrangement (40), the device (10) comprising a low-pressure inlet port (12), a leakage inlet (16), a low-pressure chamber (18) having a low-pressure opening (22) for establishing fluid communication with the machine section (26), a high-pressure outlet port (14), and a high-pressure chamber (20) that is in fluid communication with the high-pressure outlet port (14), the high-pressure chamber (20) having a high-pressure opening (24) for establishing fluid communication with the machine section (26), wherein the low-pressure inlet port (12) is in fluid communication with the low-pressure chamber (18), wherein a leakage path (36) extends from the high-pressure chamber (20) through the machine section (26) to the leakage inlet (16), characterized in that the device (10) further comprises a control valve member (28) connecting the leakage inlet (16) to the low-pressure chamber (18), wherein the control valve member (28) trans-
(Continued)

fers to an open state when a pressure in the leakage inlet (16) with respect to a pressure in the low-pressure chamber (18) is higher than a predefined control pressure threshold. The device (10) reduces cavitation in hydraulic machine arrangements (40).

11 Claims, 3 Drawing Sheets

(51) Int. Cl.
*F04B 53/06* (2006.01)
*F15B 20/00* (2006.01)

(52) U.S. Cl.
CPC ..... *F04B 2201/0208* (2013.01); *F04B 2201/0803* (2013.01)

(56) References Cited

U.S. PATENT DOCUMENTS 4,576,554 A * 3/1986 Wagenseil ..... F04B 1/141
417/270
5,205,124 A * 4/1993 Budzich ..... F03C 1/0655
184/6.17
5,419,130 A * 5/1995 Ruckgauer ..... F04B 53/04
184/1.5
2009/0290996 A1* 11/2009 Ishizaki ..... F04B 1/2042
417/269
2011/0079293 A1* 4/2011 Gollner ..... F04B 53/18
137/312

* cited by examiner

DEVICE FOR SUPPLYING PORTS TO A MACHINE SECTION OF A HYDRAULIC MACHINE ARRANGEMENT

CROSS-REFERENCE TO RELATED APPLICATION

This application claims foreign priority benefits under 35 U.S.C. § 119 to German Patent Application No. 102019113536.2 filed on May 21, 2019, the content of which is hereby incorporated by reference in its entirety.

TECHNICAL FIELD

The invention relates to a device for supplying ports to a machine section of a hydraulic machine arrangement.

BACKGROUND

A hydraulic machine arrangement may e.g. be an axial piston pump, a rotary pressure exchanger or an energy recovery device, or the like. The hydraulic machine arrangement comprises moving parts for providing an energy exchange. In the embodiment of an axial piston pump, the hydraulic machine arrangement comprises a low-pressure inlet and a high-pressure outlet for the fluid-to-be-pumped. The inlet and the outlet are in fluid communication with a rotor, which rotates around a rotation axis. The rotor is a component of a machine section of the hydraulic machine arrangement. The rotor has ducts. The rotation of the rotor alternately arranges the ducts in fluid communication with the inlet and the outlet. Each duct comprises a piston that is slidable along the duct. The pistons are configured to move away from the inlet when the duct is in fluid communication with the inlet. This movement causes a suction force such that fluid flows from the inlet into the respective duct. Furthermore, the pistons are configured to move towards the outlet when the duct is in fluid communication with the outlet. When moving towards the outlet the pistons push out any fluid in the duct to the high-pressure outlet. This increases the pressure of the fluid-to-be-pumped at the high-pressure outlet. Usually, this also leads to a leakage of fluid between the cylinder and the duct into a hollow of the axial piston pump. The leaked fluid may return to the inlet along a leakage path through the hydraulic machine arrangement via a leakage inlet. EP 3 109 470 A1 shows hydraulic machine arrangement comprising a leakage inlet.

When the piston moves away from the inlet, the piston causes a reduction of the pressure at the inlet. This causes the fluid-to-be-pumped to flow from the low-pressure chamber into the duct. This may lead to cavitation, e.g. if the fluid flow through the inlet cannot compensate the pressure reduction at the inlet, or if the static pressure of the fluid falls below its boiling pressure. Cavitation may damage the hydraulic machine arrangement.

SUMMARY

An object of the invention may be to provide a device that reduces cavitation in hydraulic machine arrangements.

According to an aspect of the invention, a device for supplying ports to a machine section of a hydraulic machine arrangement is provided, the device comprising a low-pressure inlet port, a leakage inlet, a low-pressure chamber having a low-pressure opening for establishing fluid communication with the machine section, a high-pressure outlet port, and a high-pressure chamber that is in fluid communication with the high-pressure inlet port, the high-pressure chamber having a high-pressure opening for establishing fluid communication with the machine section, wherein the low-pressure inlet port is in fluid communication with the low-pressure chamber, wherein a leakage path extends from the high-pressure chamber through the machine section to the leakage inlet, characterized in that the device further comprises a control valve member connecting the leakage inlet to the low-pressure chamber, wherein the control valve member transfers to an open state when a pressure in the leakage inlet with respect to a pressure in the low-pressure chamber is higher than a predefined control pressure threshold.

The device for supplying ports to a machine section of a hydraulic machine arrangement provides a pressure control in the low-pressure chamber by the control valve member. The pressure in the low-pressure chamber depends on the flow of the fluid through the low-pressure port into the low-pressure chamber and the suction force being generated by the machine section of the hydraulic machine arrangement. If the pressure in the low-pressure chamber relative to the pressure in the leakage inlet drops below the predefined pressure threshold, the control valve member opens. Since the pressure of the fluid in the leakage inlet is higher than in the low-pressure chamber, the fluid in the leakage inlet will then flow into the low-pressure chamber and add to the fluid flow through the low-pressure inlet. This reduces the risk of cavitation in the machine section. The hydraulic machine arrangement refuels the fluid at the leakage inletport due to the leakage. The fluid flows along the leakage path, i.e. from the high-pressure chamber through the machine section of the hydraulic machine arrangement to the leakage inletport. The predefined control pressure threshold is chosen to be above a pressure that might cause cavitation in the low-pressure chamber. Hence, the increase or stabilization of the pressure in the low-pressure chamber reduces cavitation in the low-pressure chamber. Furthermore, at a given pressure at the high-pressure outlet port, the pressure difference between the machine section and the high pressure chamber is reduced.

After the pressure difference between the low-pressure chamber and the leakage inlet falls below the control pressure threshold, the control valve member may transfer into a closed state. The fluid-to-be-pumped may for example be water.

The control valve member may e.g. be a one-way valve. The predefined control pressure may for example be more than 3 bar, preferably a pressure, which is in between, preferably in the middle, a pressure at the low-pressure chamber and a pressure at the high-pressure chamber. This may reduce the leakages. If the control pressure is in the middle between the pressure at the low-pressure chamber and the pressure at the high-pressure chamber, the leakage may be reduced to half.

The ports may also be ports that may be connected to ports of fluid lines etc.

In an example, the control valve member may be an adjustable valve member for adjusting the predefined control pressure.

The control pressure may then be adapted to different operating conditions of the hydraulic machine arrangement. For example, if the hydraulic machine arrangement comprises an operating point at a low pressure and another operating point at a high pressure, the adjustable control valve member may be adapted to those operating points. For the low operating point, the control valve member may be adjusted to a low control pressure threshold. In a hydraulic machine arrangement that is a pump, this avoids an overfilling of the ducts during a sucking stroke. For the high operating point, the control valve member may be adjusted to a high control pressure threshold. In a hydraulic machine arrangement that is a pump, this supports the filling of the ducts during a sucking stroke via a connection in the duct up though the middle of a bearing element of a piston of the pump. This reduces cavitation.

According to an example, the device comprises a filling valve member connecting the low-pressure chamber to the machine section, wherein the filling valve member transfers to an open state when the pressure in the low-pressure chamber with respect to a pressure in the machine section is higher than a predefined filling pressure threshold.

The filling valve member may for example be a one-way valve. Furthermore, the opening of the filling valve may enable a filling of the machine section of the hydraulic machine arrangement with the fluid-to-be-pumped before the use of the hydraulic machine arrangement. In an example, the predefined filling pressure threshold may be less than 2 bar, preferably between 2 bar and 0 bar, further preferably 0.5 bar.

According to a further example, the device may comprise a flush valve member connecting the low-pressure chamber to the high-pressure chamber, wherein the flush valve member transfers to an open state when the pressure in the low-pressure chamber is higher than a predefined flush pressure threshold with respect to a pressure in the high-pressure chamber The flush valve member may for example be a one-way valve. Furthermore, the opening of the flush valve may enable a filling of a system after the high-pressure outlet port with the fluid to be pumped. This may be performed before using the hydraulic machine arrangement but after connecting the high-pressure outlet port to the system into which the fluid will be pumped. In an example, the predefined flush pressure threshold may be below 1 bar, preferably between 1 bar and 0 bar, further preferably 0 bar. The predefined flush pressure threshold may be chosen such that the flush valve member opens if there is no high-pressure in the high-pressure chamber.

According to another example, the device further may comprise a flow-measuring device between the leakage inlet and the machine section in the leakage path.

The flow-measuring device is configured to measure the flow of the fluid through the leakage inlet. The leakage between the high-pressure chamber and the machine section is assumed to define the main amount of the leakage flow of the hydraulic machine arrangement from the device into the machine section. Thus, the flow-measuring device at the leakage inlet provides information about the leakage flow between the high-pressure chamber and the machine section. Furthermore, the leakage device provides information about the leakage in the hydraulic machine arrangement, only, without measuring any further leakage flow outside of the hydraulic machine arrangement.

The flow measuring device may be integrated in the machine section.

In an alternative example, no flow measuring device is present. Instead a cap is mounted which provides fluid communication between the leakage inlet to the machine section.

According to an example, the device is a portflange of a hydraulic machine arrangement.

A user may easily connect the portflange providing the ports and the pressure chambers to the machine section of the hydraulic machine arrangement. Furthermore, a user may replace the portflange by another portflange for upgrading the hydraulic machine arrangement.

The inlet port may comprise the leakage inlet. The leakage inlet is connected to a tube, which is attached to the inlet port. In this example, the leakage path is arranged outside the device.

In a further aspect of the invention, a hydraulic machine arrangement is provided comprising a machine section and a device according to the preceding description, the machine section comprising a rotor that is rotatably mounted around a rotational axis, the rotor having a plurality of ducts rotating around a rotational axis of the rotor, each duct comprising a barrier element closing the duct, wherein the barrier element is slidably movable along the duct, wherein the rotor is arranged at the device, wherein each duct is alternately arranged in fluid communication with the low-pressure opening and in fluid communication with the high-pressure opening by a rotation of the rotor, wherein the leakage path extends through the duct if the duct is in fluid communication with the high-pressure chamber.

The effects and further embodiments of the hydraulic machine arrangement according to the present invention are analogous to the effects and embodiments of the device according to the description mentioned above. Thus, it is referred to the above description of the device.

The barrier element may for example be a piston. In an alternative example, the barrier element may be a barrier fluid that does not mix with the fluid-to-be-pumped.

According to an example, the machine section further comprises a machine chamber, wherein the rotor is arranged between the machine chamber and the device, wherein the machine chamber is in fluid communication with at least the ducts being in fluid communication with the high-pressure chamber, the machine chamber comprising a leakage outlet in the leakage path, the leakage outlet being in fluid communication with the leakage inlet.

The machine chamber collects the leakage flow coming from the high-pressure chamber through the ducts. The leakage outlet provides the leakage flow to the leakage inlet. Furthermore, the flow measuring device may be arranged in the machine chamber.

According to another example, the machine chamber further comprises a venting opening, the venting opening providing fluid communication between the machine chamber and an outer environment, wherein a removable plug member closes the venting opening.

By removing the plug member from the venting opening, the machine chamber is in fluid communication with the surrounding environment. When filling the machine chamber with fluid-to-be-pumped through the filling valve member, any other fluid in the machine chamber, e.g. air, may flow out of the machine chamber through the venting opening. This simplifies the filling of the machine chamber with the fluid-to-be-pumped.

According to an example, the machine section is an axial piston pump.

According to another example, the machine section is an energy recovery device.

In a further example, the hydraulic machine arrangement comprises the device for providing ports to a machine section. Thus, the device may be integrated e.g. in the axial piston pump or in the energy recovery device.

BRIEF DESCRIPTION OF THE DRAWINGS

Further features, details and advantages of the invention result from the wording of the claims as well as from the following description of exemplary embodiments based on the drawings. The figures show:

DETAILED DESCRIPTION

Figure 1A:
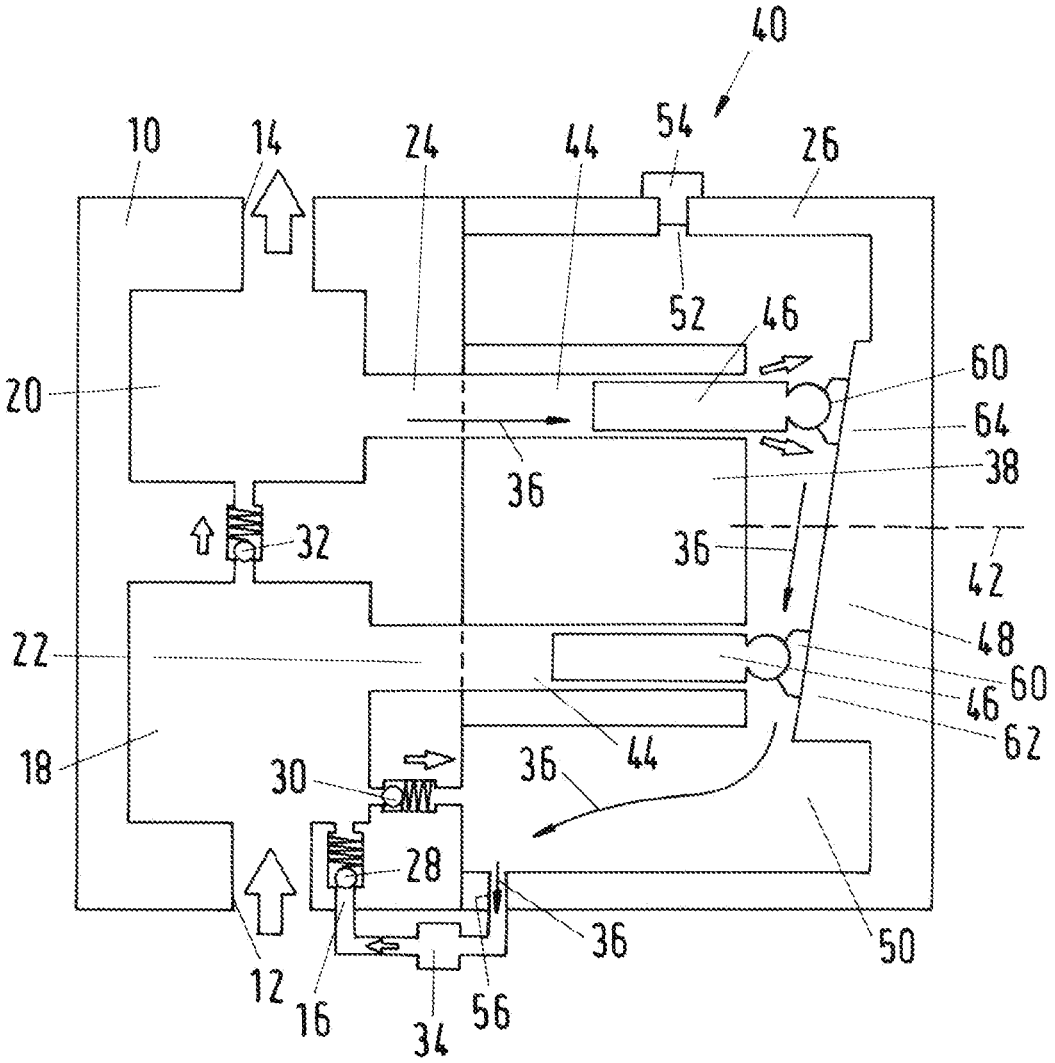
FIG. 1*a, b* a schematic drawing of embodiments of the hydraulic machine arrangement.

FIG. 1*a* shows the hydraulic machine arrangement, the hydraulic machine arrangement in its entirety having the reference sign 40.

The hydraulic machine arrangement 40 comprises a machine section 26 and a device 10 for supplying ports. In this embodiment, the machine section 26 of the hydraulic machine arrangement 40 is an axial piston pump. Furthermore, the device 10 is a portflange closing the axial piston pump. However, this does not exclude that the machine section 26 is another kind of device, like e.g. an energy recovery device or a pressure exchanger.

The machine section 26 comprises a rotor 38 that is rotatably mounted. The rotor 38 may rotate around a rotation axis 42. Furthermore, the rotor 38 comprises ducts 44. Each duct 44 comprises a barrier element 46. In this embodiment, the barrier element 46 is a piston.

The barrier element 46 is slidably mounted in the duct 44. The barrier element 46 may slide along the duct 44. A rotation of the rotor 38 rotates the ducts 44 and the barrier elements 46 around the rotation axis 42.

The device 10 comprises a low-pressure inlet port 12 that is in fluid communication with a low-pressure chamber 18 having a low-pressure opening 22 for establishing fluid communication with the machine section 26. Furthermore, the device 10 comprises a high-pressure outlet port 14 that is in fluid communication with a high-pressure chamber 20 having a high-pressure opening 24 for establishing fluid communication with the machine section 26.

A fluid to be pumped, e.g. water, can flow through the low-pressure opening 22 and the high-pressure opening 24. This means that the fluid-to-be-pumped may flow from the low-pressure chamber 18 through the low-pressure opening 22 into the machine section 26. Furthermore, the fluid may flow from the machine section 26 through the high-pressure opening 24 into the high-pressure chamber 20.

Due to the rotation of the rotor 38, the ducts 44 are alternately arranged at the low-pressure opening 22 and the high-pressure opening 24 when rotating around the rotation axis 42. Thus, a duct 44 may first be placed at the low-pressure opening 22 being in fluid communication with the low-pressure chamber 18. Afterwards, the duct 44 may be placed at the high-pressure opening 24 being in fluid communication with the high-pressure chamber 20. When the duct 44 is arranged at the low-pressure opening 22, the barrier element 46 is configured to move along the duct 44 away from the low-pressure opening 22. This causes an increase of the volume of the duct 44 that results in a decrease of the pressure in the low-pressure chamber 18. When the duct 44 is arranged at the high-pressure opening 24, the barrier element 46 is configured to move along the duct 44 towards the high-pressure opening 24. This causes a decrease of the volume of the duct 44, which results in an increase of the pressure in the high-pressure chamber 20.

The pistons being the barrier elements 46 each comprise a bearing element 60. The bearing element 60 is configured to glide along a gliding plate 48. The gliding plate 48 has a small angle to the normal plane of the rotational axis 42. The angle is such that a first section 62 of the gliding plate 48 facing the low-pressure opening 22 has an increasing distance to the rotor 38 along the rotation direction of the rotor 38. A second section 64 of the gliding plate 48 facing the high-pressure opening 24 has a decreasing distance to the rotor 38 along the rotation direction of the rotor 38. This means, that the gliding plate 48 will guide the barrier element 46 via the corresponding bearing element 60 towards the low-pressure opening 22 when the corresponding duct 44 moves along the low-pressure opening 22 while rotating around the rotation axis 42. Furthermore, the gliding plate 48 will guide the barrier element 46 via the corresponding bearing element 60 away from the high-pressure opening 24 when the corresponding duct 44 moves along the high-pressure opening 24 while rotating around the rotation axis 42.

Thus, the barrier element 46 of a duct 44 moving along the low-pressure opening 22 will suck the fluid-to-be-pumped into the duct 44 and press out the fluid-to-be-pumped at the high-pressure opening 24.

While the barrier element 46 presses out the fluid-to-be-pumped from the duct 44 at the high-pressure opening 24, a small amount of the fluid-to-be-pumped will leak between the barrier element 46 and a wall of the duct 44, from a valve system (not shown), from the bearing element 60 and a channel (not shown) through the piston, from between the bearing element and the gliding plate 48, into a machine chamber 50 of the machine section 26. The machine chamber 50 may collect the leaked fluid-to-be-pumped.

The machine chamber 50 comprises a leakage outlet 56 that is in fluid communication with a leakage inlet 16 of the device 10. The leakage inlet 16 is connected to a control valve member 28 that connects the leakage inlet 16 to the low-pressure chamber 18. The control valve member 28 opens if the pressure in the leakage inlet 16 with respect to a pressure in the low-pressure chamber 18 is higher than a predefined control pressure threshold. Otherwise, the control valve member 28 is closed. Then, it blocks the passage between the leakage inlet 16 and the low-pressure chamber 18. If the control valve member 28 is open, the leaked fluid may flow from the leakage outlet 56 through the leakage inlet 16 and the control valve member 28 into the low-pressure chamber 18. The control valve member 28 may be a one-way valve, which only allows fluid flow from the leakage inlet 16 into the low-pressure chamber 18. The predefined control pressure threshold may for example be more than 3 bar, preferably 5 bar.

A flow-measuring device 34 may be arranged between the leakage outlet 56 and the leakage inlet 16. The flow-measuring device 34 may measure the flow of the leaked fluid.

The leaked fluid follows a leakage path 36. The leakage path 36 starts at the high-pressure opening 24 and extends through a duct 44, which is arranged at the high-pressure opening 24 during a part of the rotation of the rotor 38. The leakage path 46 extends between the corresponding barrier element 46 and the wall of the duct 44. Then, the leakage path 36 extends through the machine section 26 by crossing the machine chamber 50 up to the leakage outlet 56. The leakage path 6 further passes the flow measuring device 34 and ends at the leakage inlet 16.

The leaked fluid may pass the control valve member 28 into the low-pressure chamber 18 if the pressure in the leakage inlet 16 with respect to the pressure in the low-pressure chamber is above the predefined control pressure threshold. The fluid flowing through the control valve member 28 adds to the fluid in the low-pressure chamber 18. Hence, this additional flow combines with the flow of the fluid-to-be-pumped through the low-pressure inlet port 12 to increase the total inflow into the low-pressure chamber. That reduces the probability of cavitation in the low-pressure chamber 18 and the machine section 26 during the movement of the rotor 38. Furthermore, at a given pressure at the high-pressure outlet port 14, the pressure difference between the machine section 26 and the high pressure chamber 20 is reduced.

The device 10 further comprises a filling valve member 30, which is located between the low-pressure chamber 18 and the machine section 26. Particularly, the filling valve member 30 begins at the low-pressure chamber 18 and ends at the machine chamber 50 of the machine section 28. The filling valve member 30 opens if the pressure in the low-pressure chamber 18 with respect to a pressure in the machine chamber 50 is higher than a predefined filling pressure threshold. The predefined filling pressure threshold is a value of less than 2 bar, preferably between 2 bar and 0 bar, further preferably 0.5 bar. Otherwise, the filling valve member 30 is closed. Furthermore, the filling valve member 30 only allows a flow from the low-pressure chamber 18 into the machine chamber 50 of the machine section 26. The filling valve number 30 may be a one-way valve. The filling valve member 30 may be used to fill the machine chamber 50 with the fluid-to-be-pumped before the use of the hydraulic machine arrangement 40.

Furthermore, the machine section 26 may comprise a venting opening 52 and a removable plug 54. The venting opening 52 may be arranged at the machine chamber 50. Furthermore, the venting opening 52 may connect the machine chamber 50 to the surrounding environment in a fluid communicative manner. The removable plug 54 may be placed in the venting opening 52 to close the venting opening 52.

The removable plug 54 can be removed from the venting opening 52 to vent the machine chamber 50. This is particularly useful when the machine chamber 50 shall be filled with the fluid-to-be-pumped. Then, a user may first remove the removable plug 54 before filling the fluid-to-be-pumped into the low-pressure chamber 18 with a pressure above the predefined filling pressure threshold. After the filling process, the removal plug 54 may be rearranged in the venting opening 52 to close the venting opening 52.

The device 10 further comprises a flush valve member 32 being arranged between the low-pressure chamber 18 and the high-pressure chamber 20. In an open state, the flush valve member 32 allows a flow from the low-pressure chamber 18 into the high-pressure chamber 20. The flush valve member 32 may open if there is no high-pressure in the high-pressure chamber 20. For example, the flush valve member 32 opens if the pressure in the low-pressure chamber 18 with respect to a pressure in the high-pressure chamber 20 is higher than a predefined flush pressure threshold. The flush pressure threshold may be below 1 bar, preferably between 1 bar and 0 bar, further preferably the 0 bar. The flush valve member 32 may be a one-way valve.

The flush valve member 32 may be used before the use of the hydraulic machine arrangement 40 to fill the system with the fluid to be pumped, wherein the system is in fluid communication with the high-pressure outlet port 14. The fluid-to-be-pumped is then introduced into the low-pressure chamber 18 through the low-pressure inlet port 12. As long as there is no high-pressure in the high-pressure chamber 20, the flush valve member 32 opens and the fluid-to-be-pumped may flow through the flush valve member 32 into the high-pressure chamber 20 and further through the high-pressure outlet port 14 into the system.

Figure 1B:
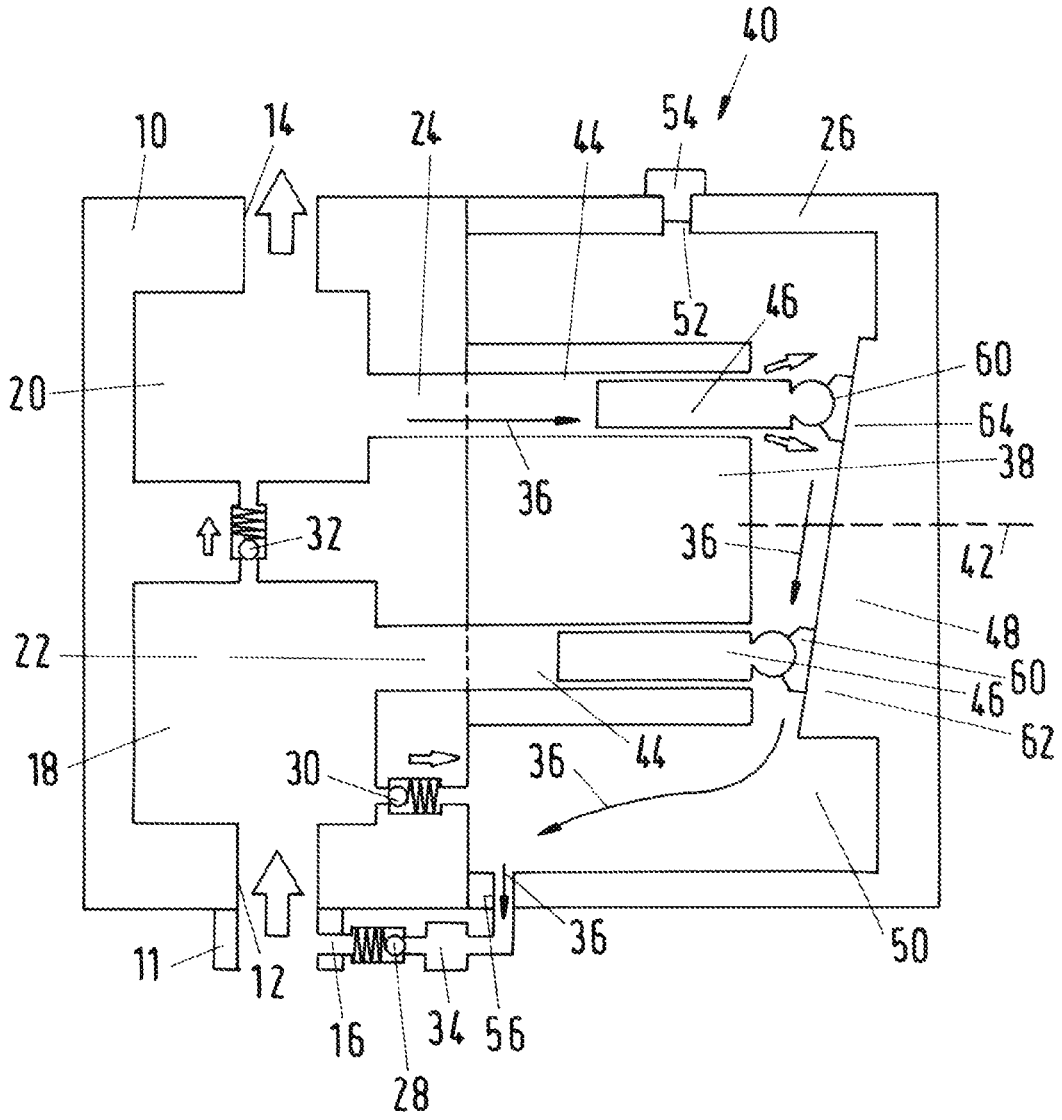

In FIG. 1*b*, the leakage inlet 16 is connected to a tube 11, which is attached to the inlet port 12. The inlet port 12 therefore comprises the leakage inlet 16. In this example, the leakage path 36 is arranged outside the device 10. The collected leakage flow enters the device 10 via the inlet port 12.

Figure 2A:
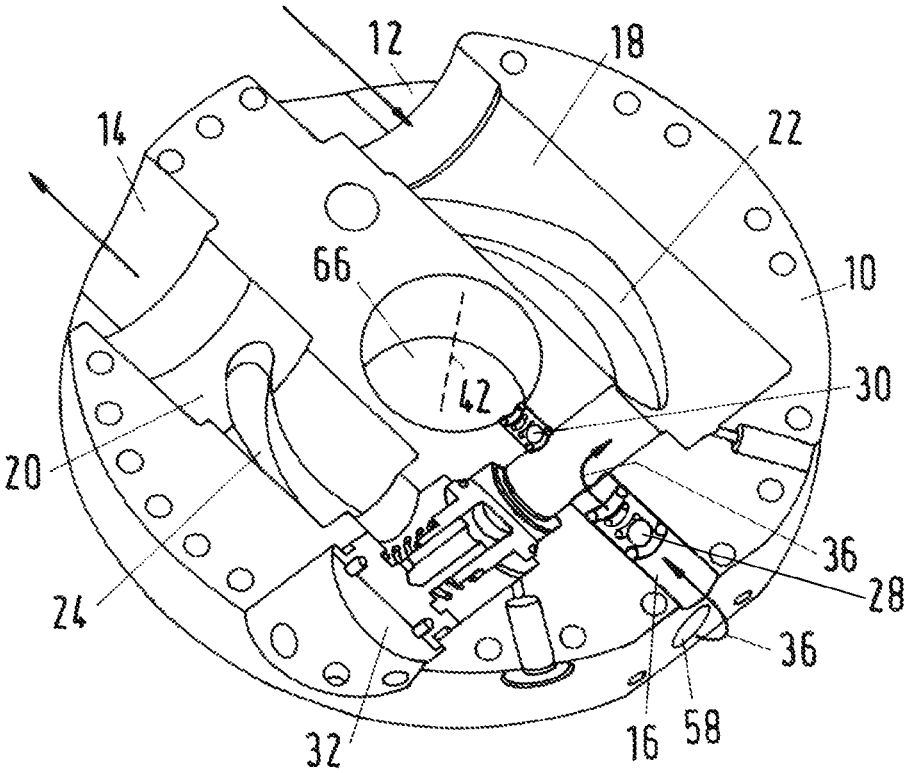
FIG. 2*a, b* schematic drawings of cross sections of the device.
Figure 2B:
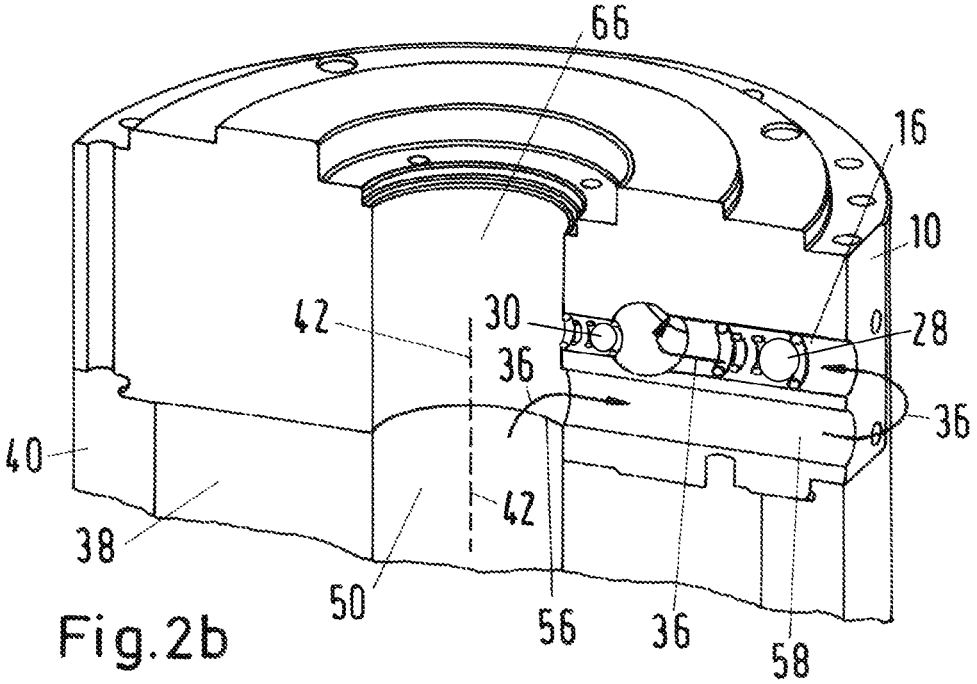

FIGS. 2*a* and 2*b* show schematic cross-sections of the device 10. Same reference numerals denote the same elements as in the description of FIG. 1.

FIG. 2*a* shows a cross-section of the device 10, wherein the device 10 is an end plate for a hydraulic machine arrangement. The cross-section is arranged in a plane being normal to the rotational axis 42 of the hydraulic machine arrangement. In this embodiment, the hydraulic machine arrangement comprises a machine chamber 50 that extends through the rotor 38 along the rotational axis 42 through the device 10. The device 10 therefore comprises a device opening 66 in the center that is in fluid communication with a machine chamber of a hydraulic machine arrangement.

In this embodiment, the leakage outlet is arranged at the device 10. The device 10 comprises a leakage channel 58, which connects the leakage outlet to the surrounding environment. The leakage path 36 extends through the leakage channel 58. A flow-measuring device may be connected to the leakage channel 58 and to the leakage inlet 16 bridging the distance between the leakage channel 58 and the leakage inlet 16.

As is further shown in that embodiment, the filling valve 30 is arranged between the low-pressure chamber 18 and the device opening 66, which is in fluid communication with the machine chamber.

In a plane being normal to the rotational axis 42, the low-pressure opening 22 and the high-pressure opening 24 are arc-shaped. They follow the trajectory of an entrance into a duct, which rotates around the rotational axis 42. At the trajectory of the ducts around the rotational axis 42 between the low-pressure opening 22 and the high-pressure opening 24, the device 10 closes the corresponding openings of the ducts.

FIG. 2*b* shows a cross-section of the device 10 in a plane that comprises the rotational axis 42. This figure shows in further detail how the leakage channel 58 connects to the device opening 66 and is in fluid communication with the machine chamber 50 of the hydraulic machine arrangement 40.

The invention is not limited to one of the aforementioned embodiments. It can be modified in many ways.

All features and advantages resulting from the claims, the description and the drawing, including constructive details, spatial arrangements and procedural steps, may be essential for the invention both in themselves and in various combinations.

What is claimed is:

1. A device for supplying ports to a machine section of a hydraulic machine arrangement, the device comprising a low-pressure inlet port, a leakage inlet, a low-pressure chamber having a low-pressure opening for establishing fluid communication with the machine section, a high-pressure outlet port, and a high-pressure chamber that is in fluid communication with the high-pressure outlet port, the high-pressure chamber having a high-pressure opening for establishing fluid communication with the machine section, wherein the low-pressure inlet port is in fluid communication with the low-pressure chamber, wherein a leakage path extends from the high-pressure chamber through the machine section to the leakage inlet, wherein the device further comprises a control valve member connecting the leakage inlet to the low-pressure chamber, wherein the control valve member transfers to an open state when a pressure in the leakage inlet with respect to a pressure in the low-pressure chamber is higher than a predefined control pressure threshold, and wherein the control valve member is an adjustable valve member for adjusting the predefined control pressure.

2. The device according to claim 1, wherein the device comprises a filling valve member connecting the low-pressure chamber to the machine section, wherein the filling valve member transfers to an open state when the pressure in the low-pressure chamber with respect to a pressure in the machine section is higher than a predefined filling pressure threshold.

3. The device according to claim 1, wherein the device comprises a flush valve member connecting the low-pressure chamber to the high-pressure chamber, wherein the flush valve member transfers to an open state when the pressure in the low-pressure chamber is higher than a predefined flush pressure threshold with respect to a pressure in the high-pressure chamber.

4. The device according to claim 1, wherein the device further comprises a flow-measuring device between the leakage inlet and the machine section in the leakage path.

5. The device according to claim 1, wherein the device is a portflange of the hydraulic machine arrangement.

6. The device according to claim 1, wherein the inlet port comprises the leakage inlet.

7. The hydraulic machine arrangement comprising the machine section and the device according to claim 1, the machine section comprising a rotor that is rotatably mounted around a rotational axis, the rotor having a plurality of ducts rotating around the rotational axis of the rotor, each duct comprising a barrier element closing the duct, wherein the barrier element is slidably movable along the duct, wherein the rotor is arranged at the device, wherein each duct is alternately arranged in fluid communication with the low-pressure opening and in fluid communication with the high-pressure opening by a rotation of the rotor, wherein the leakage path extends through the duct if the duct is in fluid communication with the high-pressure chamber.

8. The hydraulic machine arrangement according to claim 7, wherein the machine section further comprises a machine chamber, wherein the rotor is arranged between the machine chamber and the device, wherein the machine chamber is in fluid communication with at least the ducts being in fluid communication with the high-pressure chamber, the machine chamber comprising a leakage outlet in the leakage path, the leakage outlet being in fluid communication with the leakage inlet.

9. The hydraulic machine arrangement according to claim 8, wherein the machine chamber further comprises a venting opening, the venting opening providing fluid communication between the machine chamber and an outer environment, wherein a removable plug member closes the venting opening.

10. The hydraulic machine arrangement according to claim 7, wherein the machine section is an axial piston pump.

11. The hydraulic machine arrangement according to claim 7, wherein the machine section is an energy recovery device.

* * * * *